US009732564B2

(12) United States Patent
Jack et al.

(10) Patent No.: US 9,732,564 B2
(45) **Date of Patent: *Aug. 15, 2017**

(54) DRILLING RIG EQUIPMENT PLATFORM

(71) Applicant: Cenovus Energy Inc., Calgary (CA)

(72) Inventors: Dustin Jack, Calgary (CA); Alan Krawchuk, Calgary (CA); Jay Blythman, Regina (CA); Robert Chalifoux, St. Albert (CA); Doug Howdle, Red Deer (CA); Murray Reay, Red Deer (CA); Frank Yuzyk, Sherwood Park (CA)

(73) Assignee: Cenovus Energy Inc., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/242,288

(22) Filed: Aug. 19, 2016

(65) Prior Publication Data

US 2016/0356094 A1 Dec. 8, 2016

Related U.S. Application Data

(63) Continuation of application No. 14/490,575, filed on Sep. 18, 2014, now Pat. No. 9,447,643.

(60) Provisional application No. 61/880,712, filed on Sep. 20, 2013.

(51) Int. Cl.

| | |
|---|---|
| ***E21B 15/00*** | (2006.01) |
| ***E02D 27/02*** | (2006.01) |
| ***E02D 27/36*** | (2006.01) |
| ***E02D 27/44*** | (2006.01) |
| ***E04B 1/343*** | (2006.01) |

(52) U.S. Cl.

CPC ..... *E21B 15/00* (2013.01); *E02D 27/02* (2013.01); *E02D 27/36* (2013.01); *E02D 27/44* (2013.01); *E04B 1/34321* (2013.01); *E04B 1/34352* (2013.01)

(58) Field of Classification Search

CPC ..... E21B 15/00; B63B 35/38; E01D 15/14; E01D 15/24; E01C 9/08; E02D 27/02; E02D 27/36; E02D 27/44; E04B 1/34321; E04B 1/34352

See application file for complete search history.

(56) References Cited

U.S. PATENT DOCUMENTS

| | | | | | |
|---|---|---|---|---|---|
| 2,382,789 | A * | 8/1945 | Guignon, Jr. | E01C 9/086 | 15/238 |
| 3,595,140 | A * | 7/1971 | Lundin | E01C 3/006 | 404/35 |
| 3,693,729 | A * | 9/1972 | Blurton | B60V 3/025 | 114/264 |
| 3,783,627 | A * | 1/1974 | Blurton | B60V 3/025 | 114/43 |

(Continued)

*Primary Examiner* — Matthew R Buck

(74) *Attorney, Agent, or Firm* — Borden Ladner Gervais LLP; Geoffrey deKleine

(57) ABSTRACT

An aircraft-transportable platform component for supporting a drilling rig includes a buoyant body supported by a frame and lifting members coupled to the frame for engagement by an aircraft. A portion of the frame protrudes from an underside surface of the frame for anchoring the platform component in unstable ground. The buoyant body maintains a top surface of the aircraft-transportable platform component above the unstable ground.

19 Claims, 14 Drawing Sheets

(56) References Cited

U.S. PATENT DOCUMENTS 3,784,312 A * 1/1974 Gordon ..... E01C 3/006 404/35
3,785,312 A * 1/1974 Schneider ..... B63B 35/73 114/266
3,844,126 A * 10/1974 Blurton ..... B60V 3/025 405/217
3,908,784 A * 9/1975 Blurton ..... B60V 3/025 180/116
4,364,539 A * 12/1982 Drysdale ..... E21B 15/00 211/70.4
4,376,596 A * 3/1983 Green ..... E01C 9/086 283/3
4,600,336 A * 7/1986 Waller, Jr. ..... E01C 9/086 404/35
4,729,335 A * 3/1988 Vidovic ..... B63B 35/36 114/266
6,007,271 A * 12/1999 Cole ..... E01C 9/08 404/19
6,511,257 B1 * 1/2003 Seaux ..... E01C 9/086 404/34
6,733,206 B2 * 5/2004 Stasiewich ..... E01C 9/086 404/35
6,746,176 B2 * 6/2004 Smith ..... E01C 9/08 404/35
7,059,799 B1 * 6/2006 Lange ..... E01C 9/08 134/123
7,128,016 B2 * 10/2006 Olthuis ..... B63B 3/185 114/266
7,229,232 B2 * 6/2007 Amelung, Sr. ..... E01C 9/08 238/14
7,249,912 B2 * 7/2007 Reese ..... B63B 3/08 404/31
7,370,452 B2 * 5/2008 Rogers ..... E01C 9/086 52/177
7,527,451 B2 5/2009 Slater et al.
7,604,431 B2 * 10/2009 Fournier ..... E01C 9/08 404/35
8,096,728 B2 * 1/2012 Stasiewich ..... E01C 9/08 403/263
8,870,492 B2 * 10/2014 Stasiewich ..... E01C 9/08 405/39
9,011,037 B2 * 4/2015 Breault ..... E01C 9/08 404/35
2006/0016607 A1 * 1/2006 Baugh ..... E21B 7/008 175/202
2006/0153643 A1 * 7/2006 Basta ..... B63B 3/06 405/219
2008/0292397 A1 * 11/2008 Farney ..... E01C 9/086 404/32
2009/0087261 A1 * 4/2009 Fournier ..... E01C 9/086 404/35
2010/0209187 A1 * 8/2010 Relland ..... E01C 9/08 404/35
2011/0155037 A1 6/2011 Moody
2011/0233363 A1 * 9/2011 Wold ..... E01C 9/086 248/346.01
2012/0063844 A1 * 3/2012 Wold ..... E01C 5/14 404/35
2016/0115652 A1 * 4/2016 Wold ..... E01C 9/08 404/35

* cited by examiner

DRILLING RIG EQUIPMENT PLATFORM

TECHNICAL FIELD

The present application relates to platforms for supporting drilling rigs at drilling sites.

BACKGROUND DISCUSSION

In order to locate oil reserves, stratigraphic wells are drilled and geological data is collected therefrom. Drilling of stratigraphic wells is typically performed in the winter months because access to remote locations is possible by way of temporary roads built across the frozen ground. Building temporary roads and drilling sites over unfrozen, marshy ground is more difficult and presents environmental challenges. Therefore, the drilling season has traditionally been limited to about 10 weeks per year.

SUMMARY

In an aspect of the present disclosure, there is provided an aircraft-transportable platform component for supporting a drilling rig, the platform component comprising: a buoyant body supported by a frame, a portion of the frame protruding from an underside surface of the frame for anchoring the platform component in unstable ground; and lifting members coupled to the frame for engagement by connecting cables of an aircraft; wherein the buoyant body maintains a top surface of the aircraft-transportable platform component above the unstable ground.

In another aspect of the present disclosure, there is provided a platform for supporting a drilling rig, the platform comprising: multiple aircraft-transportable platform components, each aircraft-transportable platform component comprising: a buoyant body supported by a frame, a portion of the frame protruding from an underside surface of the frame for anchoring the platform component in unstable ground, wherein the buoyant body maintains a top surface of the aircraft-transportable platform component above the unstable ground; and lifting members coupled to the frame for engagement by connecting cables of an aircraft; wherein the multiple aircraft-transportable platform components are coupled to one another to provide the platform.

In yet another aspect of the present disclosure, there is provided an aircraft-transportable platform component, the aircraft-transportable platform component comprising: a buoyant body supported by a frame, a portion of the frame protruding from an underside surface of the frame for anchoring the platform component in unstable ground, the buoyant body maintaining a top surface of the aircraft-transportable platform component above the unstable ground; lifting members coupled to the frame for engagement by connecting cables of an aircraft; and a spacer selectively insertable between stable ground and the frame; wherein the spacer is omitted when the aircraft-transportable platform component is used at drilling sites having unstable ground. The spacer may be comprised of one of: foam, carbon fiber and polyethylene.

In still another aspect of the present disclosure, there is provided an aircraft-transportable platform component, the aircraft-transportable platform component comprising: a buoyant body supported by a frame, a portion of the frame protruding from an underside surface of the frame, the buoyant body maintaining a top surface of the aircraft-transportable platform component above the unstable ground; lifting members coupled to the frame for engagement by connecting cables of an aircraft; and a spacer selectively insertable between stable ground and the frame.

In another aspect of the present disclosure, the frame of the aircraft-transportable platform component comprises, a first side support and a second side support spaced from one another; and a cross-member extending between the first side support and the second side support to couple the first side support to the second side support and support the buoyant body, the cross-member being flush with an underside surface of the first side support and the second side support.

In another aspect of the present disclosure, there is provided a platform component for supporting a drilling rig, the platform component comprising: a buoyant body supported by a frame, a portion of the frame protruding from an underside surface of the frame for anchoring the platform component in unstable ground, the frame comprising: a first side support and a second side support spaced from one another; and a cross-member extending between the first side support and the second side support to couple the first side support to the second side support and support the buoyant body, the cross-member protruding from an underside surface of the first side support and the second side support; grating layered on top of the buoyant body, the grating comprising a non-slip surface; wherein the buoyant body maintains a top surface of the platform component above the unstable ground.

In another aspect of the present disclosure, the buoyant body comprises multiple buoyant components coupled to one another.

In another aspect of the present disclosure, the buoyant components are approximately 20"×20" and approximately 10" thick.

In another aspect of the present disclosure, the buoyant body is coupled to the first side support and the second side support by the bolts extending upward from the cross-members.

In another aspect of the present disclosure, the aircraft-transportable platform component comprises cutouts located in webs of the first side support and the second side support, the cutouts sized for receiving projections of the buoyant body.

In another aspect of the present disclosure, the buoyant body comprises multiple buoyant components coupled to one another and the projections are lugs projecting from the multiple buoyant components.

In another aspect of the present disclosure, the aircraft-transportable platform component comprises a second cross-member coupling the first side support and second side support, the second cross-member spaced from the cross-member.

In another aspect of the present disclosure, the first side support and the second side support are C-channels and the buoyant body and a cover are sandwiched between upper and lower flanges of the C-channels.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present application will now be described, by way of example only, with reference to the attached Figures, wherein.

DETAILED DESCRIPTION

Figure 1:
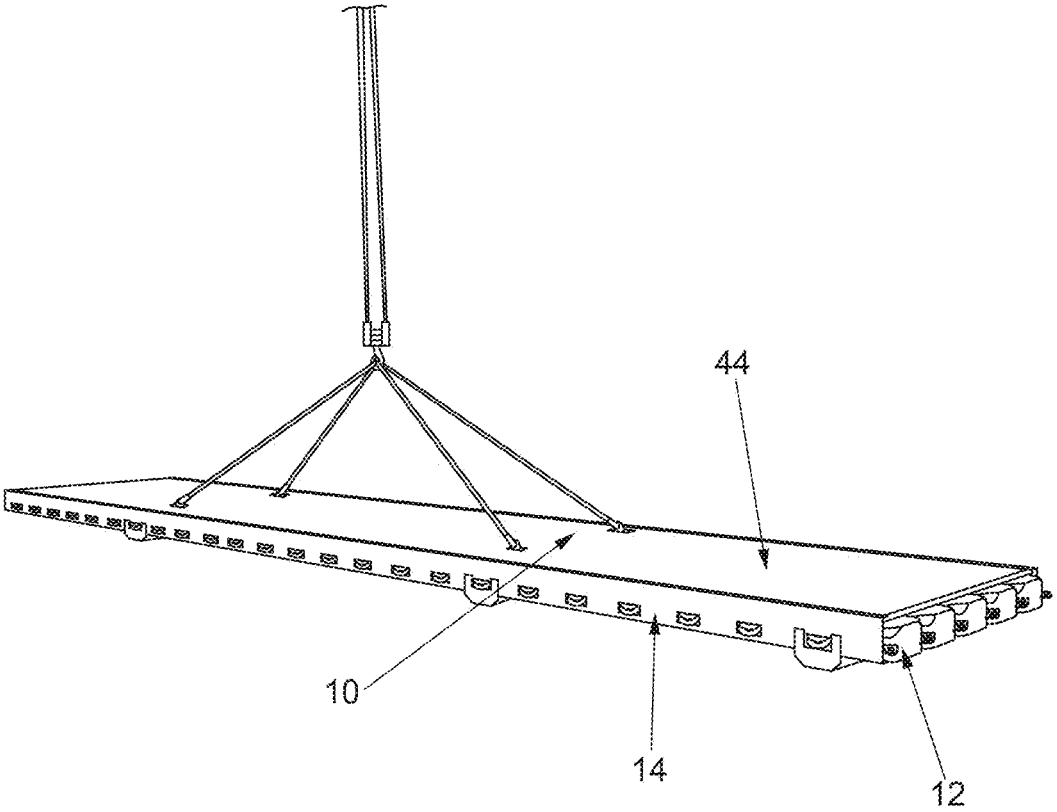
FIG. 1 is a perspective view of a platform component according to an embodiment of the present application.

It will be appreciated that for simplicity and clarity of illustration, where considered appropriate, reference numerals may be repeated among the FIGS. to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Figure 2:
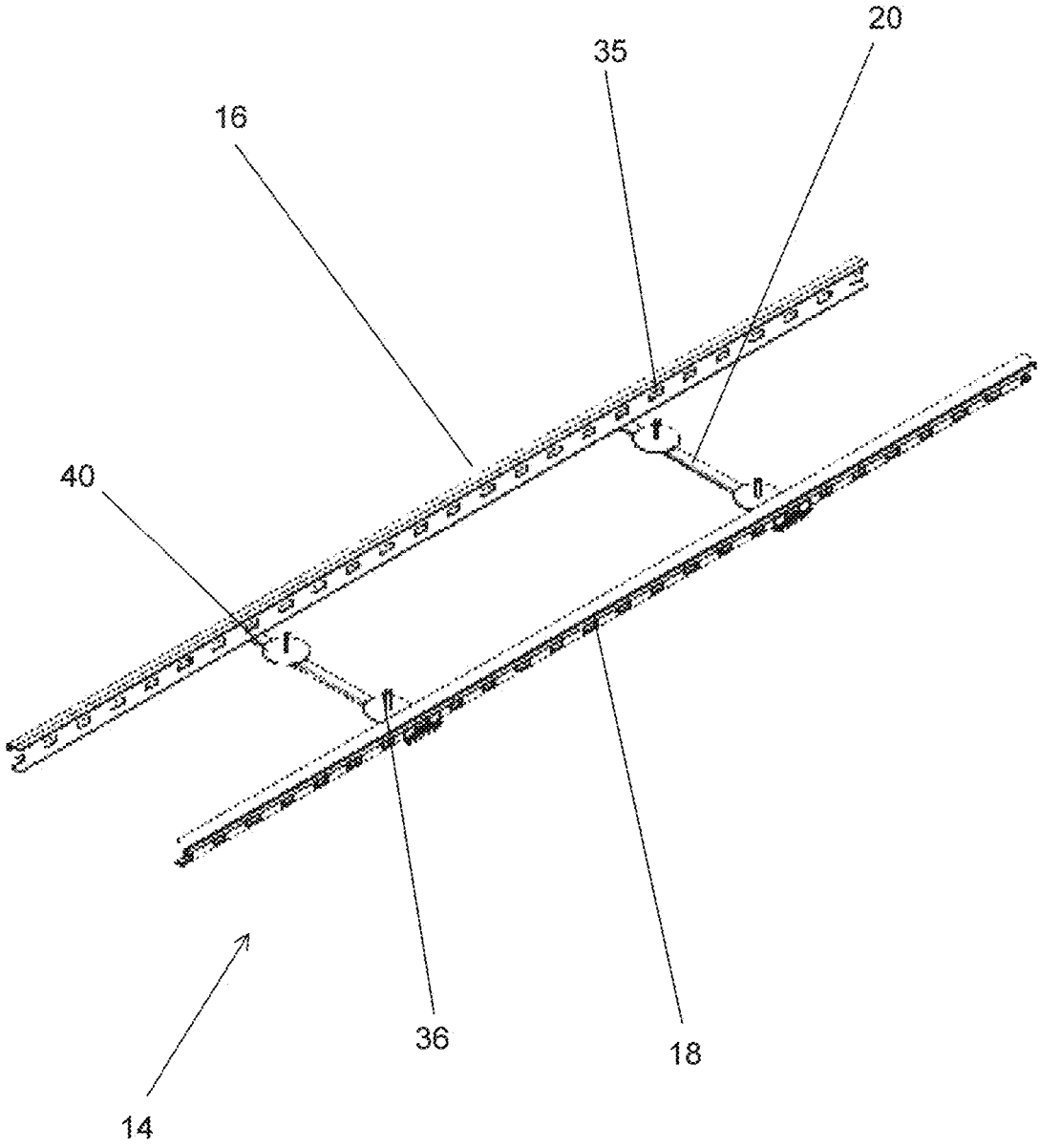
FIG. 2 is an isometric top view of portions of a platform component according to another embodiment.

Referring to FIGS. 1 and 2, an aircraft-transportable platform component 10 is generally shown. The aircraft-transportable platform component 10 may be transported by an aircraft that is a heavy cargo helicopter having minimal downwash, for example. In one embodiment, the aircraft is a Kaman K-Max™ helicopter.

The platform component 10 may be used for supporting a drilling rig on soft or unstable ground, such as mud, marsh, swamp or muskeg, for example. The term "drilling rig" generally includes all of the equipment that is used when drilling a well. The platform component 10 is able to support the assembly of the drilling rig and drilling operations on the soft or unstable ground. In general, the platform component 10 may be used on ground having a low bearing capacity, such as a bearing capacity of approximately a 3 psi or less.

Figure 3:
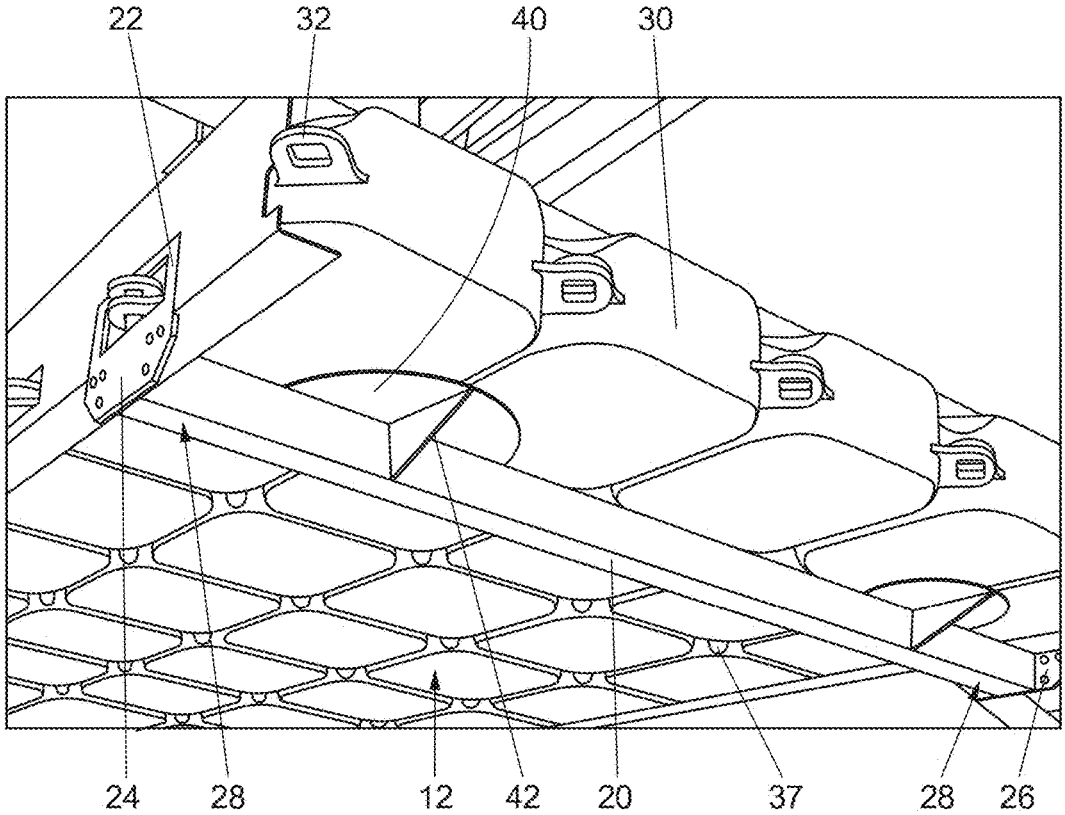
FIG. 3 is a perspective underside view of the platform component of FIG. 1.

The platform component 10 includes a buoyant body 12 that is supported by a frame 14. The frame 14 includes side supports 16 and 18 that are joined to one another by cross-members 20, which are regularly spaced along the length of the side supports 16, 18. In the embodiment shown in FIGS. 1 and 2, the side supports 16, 18 are C-channels that face one another to receive the buoyant body 12. Referring to FIG. 3, the cross-members 20 are secured to the side supports 16, 18 by plates 22 that are welded thereto. Downwardly extending portions 24 of the plates 22 are bolted to flanges 26 of the cross-members 20, which are located at ends 28 thereof.

Figure 4:
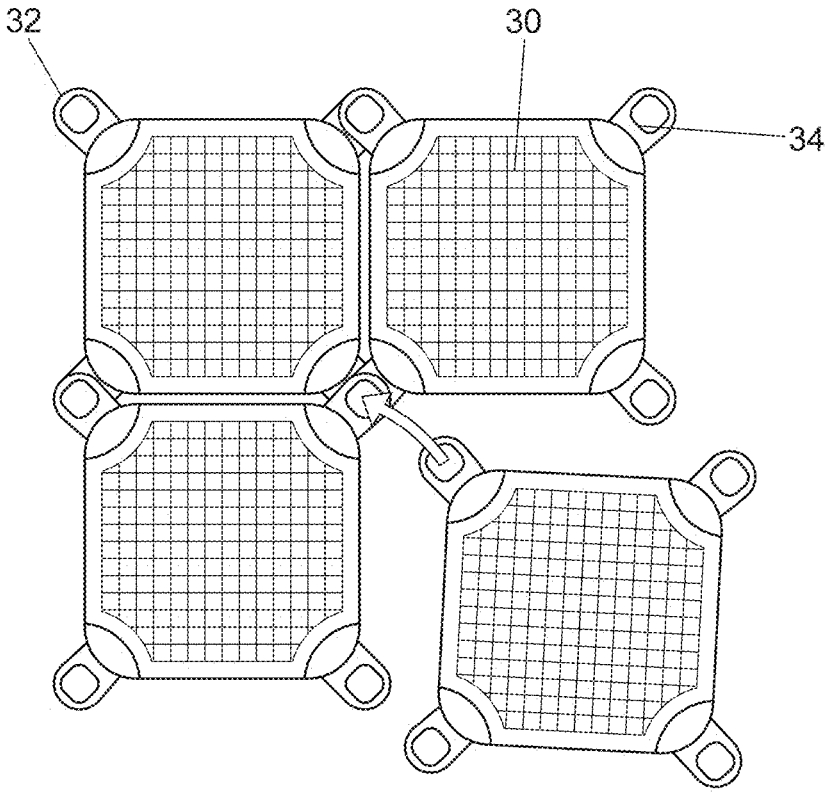
FIG. 4 is a schematic view of buoyant components of the platform component.

In the embodiment of FIGS. 1, 3 and 4, the buoyant body 12 includes individual buoyant components 30 that are coupled to one another. In other embodiments, the buoyant body 12 may be a single component. As shown in FIG. 3, the buoyant components 30 are generally cuboid and include lugs 32 that project from corners 34 thereof. As shown in FIG. 4, in order to assemble the buoyant components 30, overlapping lugs 32 of adjacent buoyant components 30 are coupled to one another by connecting pins 37 (shown in FIG. 3). In an embodiment, the buoyant components 30 are Jetfloat™ modules having a size of approximately 20"×20" and approximately 10" thick. In another embodiment, the buoyant body 12 is made up of one or more buoyant components 30 that have a larger footprint than the individual Jetfloat™ modules. As will be understood by persons skilled in the art, any component or components capable of floating and having sufficient strength and durability to support a drilling rig may be included in the platform component 10. In one example, the buoyant component 12 is made of high-density polyethylene.

The side supports 16, 18 include cutouts 35 for receiving the lugs 32 of the buoyant body 12. In embodiments in which a buoyant body 12 other than Jetfloat™ modules is used, the cutouts 35 may be omitted or sized for receiving projections extending from the buoyant body 12. A clearance is provided between the upper and lower flanges of the side supports 16, 18 to allow for some movement of the buoyant body 12 relative thereto so that the platform component 10 may conform to the soft or unstable ground upon which it sits.

Figure 5:
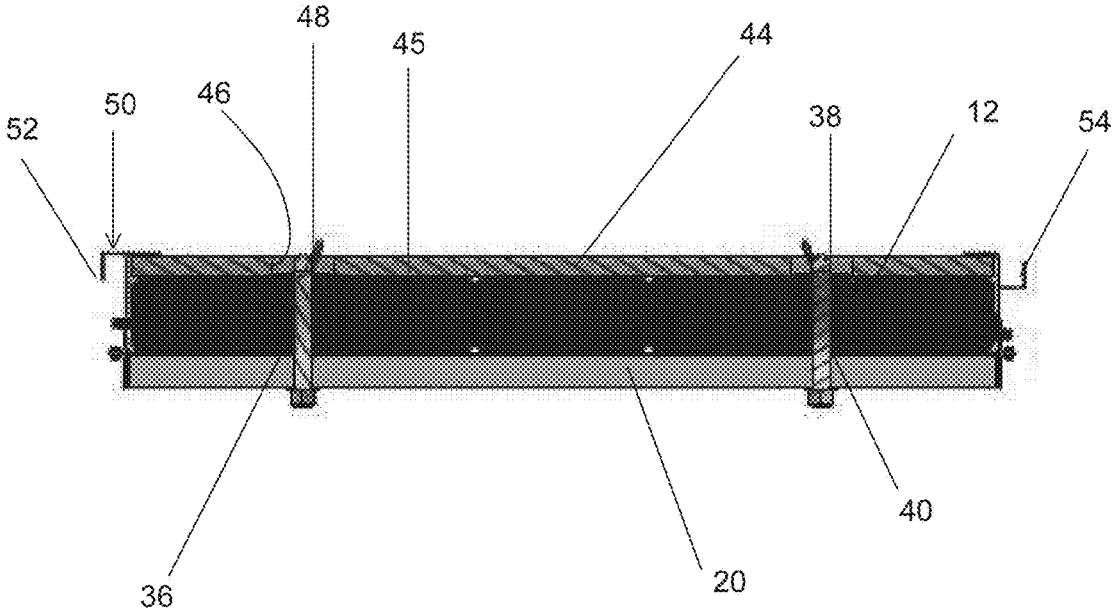
FIG. 5 is a cross-sectional view of the platform component corresponding to FIG. 2.

Referring also to FIG. 5, bolts 36 extend upwardly from the cross-members 20 and pass through upper and lower pairs of washers 38 and 40, respectively, to secure the buoyant body 12 to the frame 14. The lower washers 40 are welded to the cross-members 20 by angle supports 42, as shown in FIG. 3, and the upper washers 38 abut a top surface 45 of the buoyant body 12. The bolts 36 pass through gaps that are located between adjacent buoyant components 30. The number of cross-members 20 included in the frame 14 may be determined based on the length cross-section of the side supports 16, 18. The platform component 10 may have one or more cross-members 20 and may include one or more bolts 36 per cross-member 20.

As will be understood by a person skilled in the art, the platform component 10 may be of any construction that is capable of anchoring the platform component 10 to the unstable ground and withstanding operational loads and transportation loads. The side supports 16, 18 and the cross-members 20 may have any appropriately sized cross-section and may be secured to one another by welding or fasteners, for example. In one example, the side supports 16, 18 are 12" steel C-channels and the cross-members 20 are 6" square beams. The side supports 16, 18 and the cross-members 20 may alternatively be made of composite, aluminum or carbon fiber, for example.

Referring back to FIG. 1, a grating 44 is located on top of the buoyant body 12 and received between the side supports 16, 18. The grating 44 includes a non-slip surface so that slipping of drilling rig equipment or personnel is avoided.

Further, the grating 44 facilitates drainage through the platform component 10. In an embodiment, the grating 44 is Duragrid® T-3300.

Figure 6:
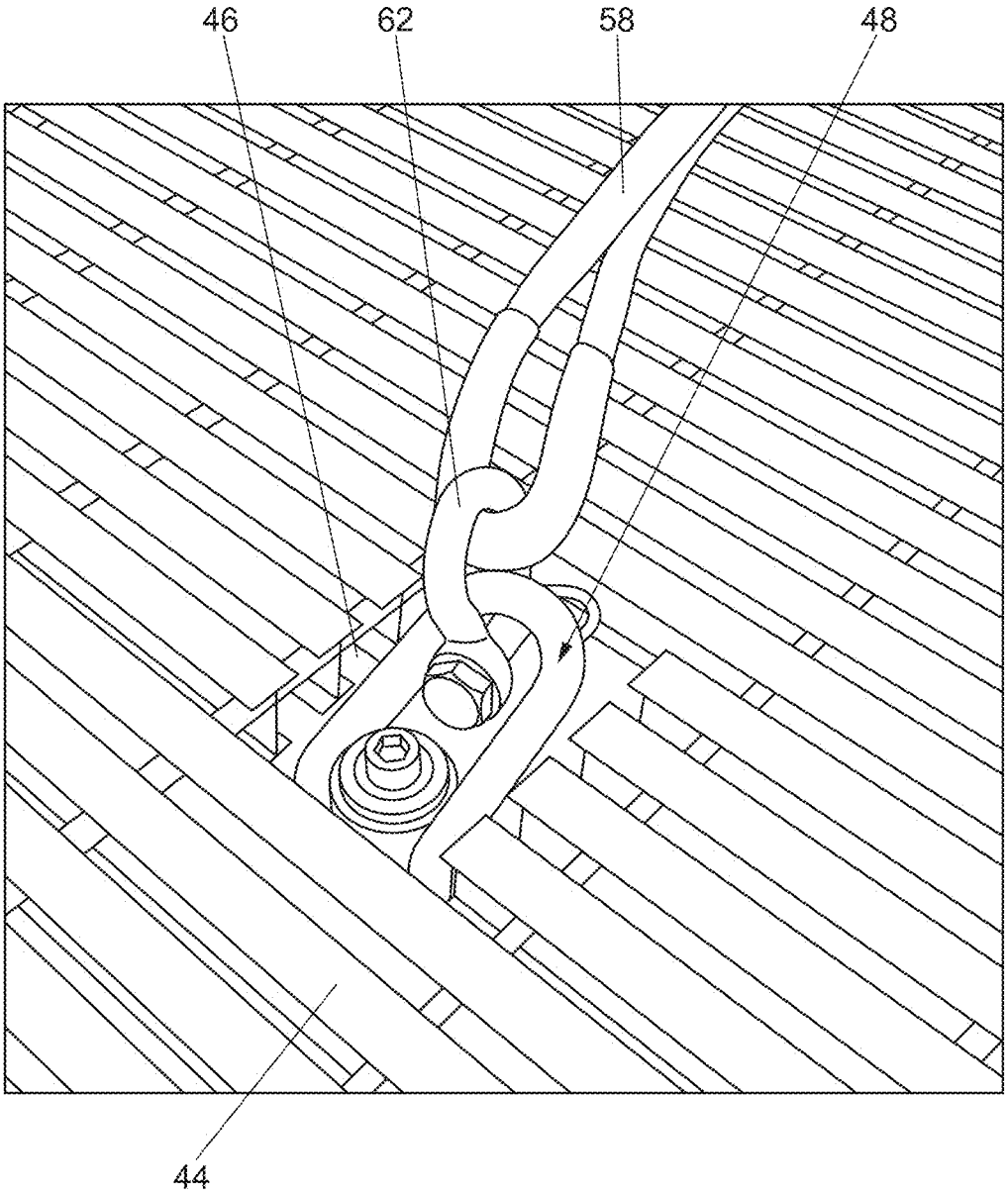
FIG. 6 is a top perspective view of the platform component of FIG. 1.

The grating 44 includes apertures 46 that extend therethrough, as shown in FIGS. 5 and 6. The apertures 46 are aligned with the bolts 36 and lifting members 48 are coupled to the ends of the bolts 36 that are accessible through the aperture 46. In an embodiment, the lifting members 48 are Crosby UNC HR-125 Swivel Hoist Rings that are screwed into the top of the bolts 36. The lifting members 48 are sized to receive hooks 62 of connecting cables 58 of an aircraft (not shown). The lifting members 48 may fold over or be removable so that during use, the lifting members 48 do not interfere with drilling operations.

Figure 7:
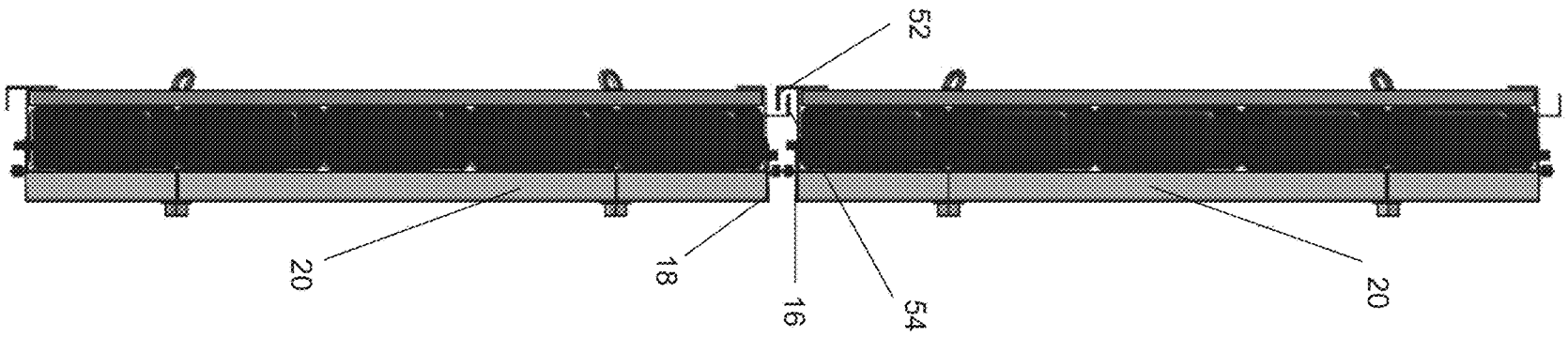
FIG. 7 is a cross-sectional view of a platform according to another embodiment.
Figure 8:
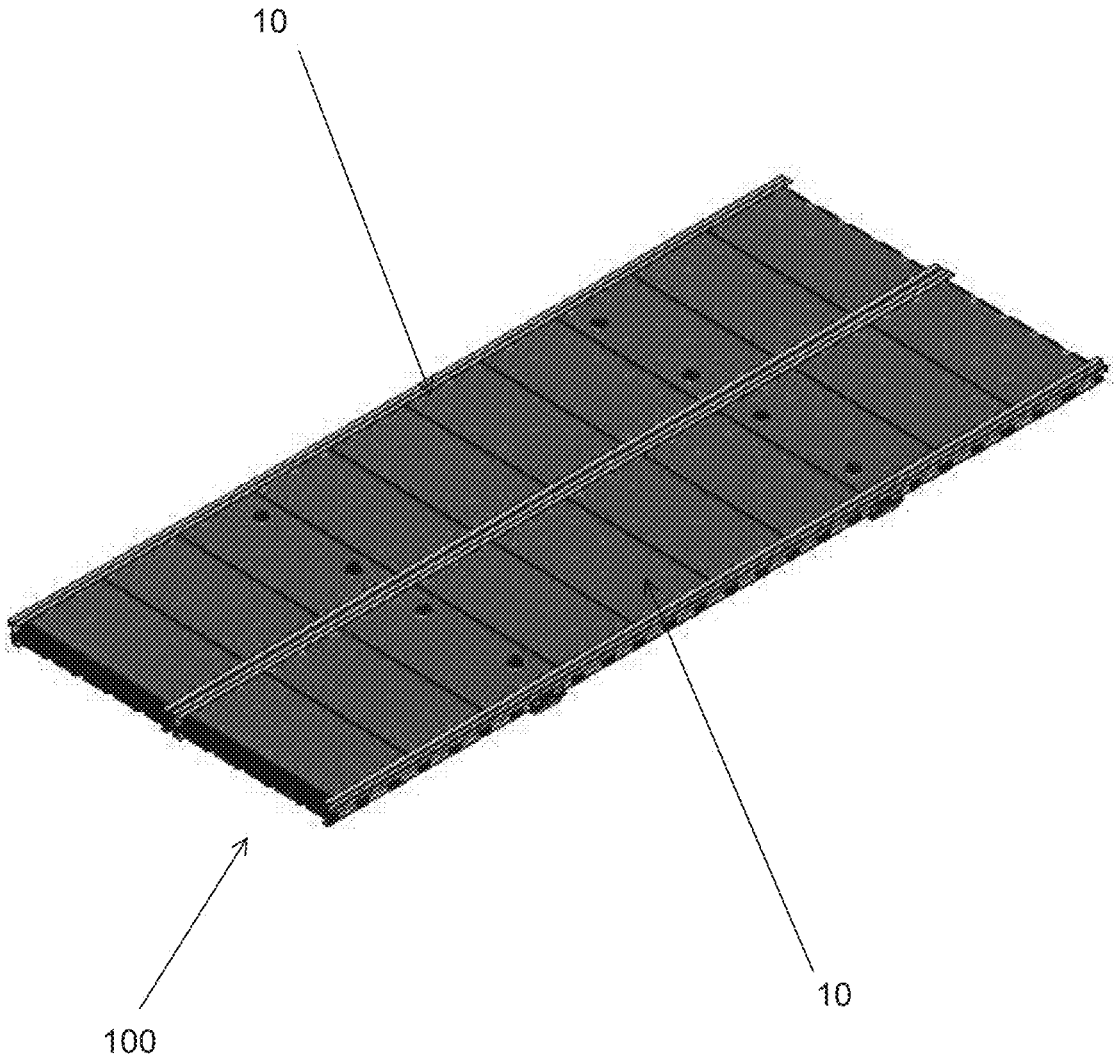
FIG. 8 is an isometric view of the platform of FIG. 7.

The platform components 10 further include brackets 50 that extend from the side supports 16, 18 at one or more locations. As shown in FIG. 5, the brackets 50 that extend from the side supports 16 include downwardly directed flanges 52 and the brackets 50 that extend from the side supports 18 include upwardly directed flanges 54. FIG. 7 shows the cooperation of brackets 50 of adjacent platform components 10 to couple the platform components 10 together. As shown, when coupled to one another to form a platform 100, the platform components 10 are arranged so that brackets 50 having downwardly directed flanges 52 are received by brackets 50 having upwardly directed flanges 54. The brackets 50 may be welded to the side supports 16, 18 or coupled thereto by fasteners, for example. Referring to FIG. 8, two platform components 10 assembled to form a platform are generally shown. In one embodiment, the platform components 10 may also be coupled to one another end-to-end in a similar manner.

In an embodiment, the platform component 10 has a width of approximately 8 ft, a length of approximately 40 ft and weighs less than 6000 lbs. In another embodiment, the platform component weighs less than 3000 lbs.

In one example, 20-25 platform components 10 are assembled to form a platform for supporting drilling operations. In this example, the platform may be 60 ft long to accommodate the drilling rig and may support more than 6000 lbs of equipment and personnel.

Figure 9:
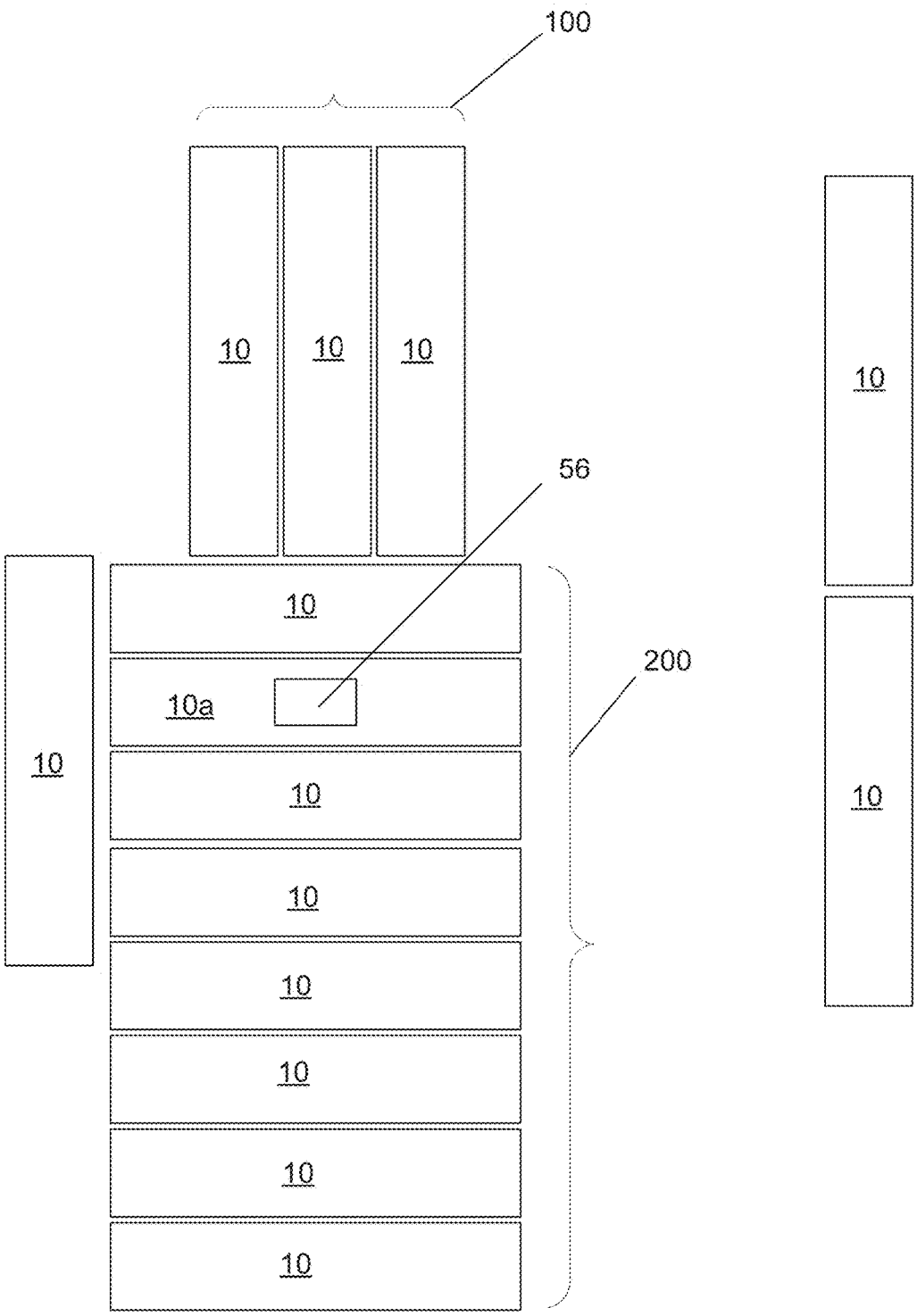
FIG. 9 is a plan view of an example drilling site.

Referring to FIG. 9, a plan view of fourteen platform components 10 assembled at a drilling site at which the ground is unstable is generally shown. The platform components 10 are delivered to the drilling site using an aircraft, such as a helicopter, prior to the arrival of the drilling rig.

The drilling site is kept as small as possible and is selected to reduce the environmental impact of the drilling operation. For example, sites including waterways, ephemeral creeks or side-hill cuts are avoided and landscape compatibility and forest ecological principles, such as succession and forest stratification, for example, are considered. Ease of land reclamation is also considered as part of the drilling site selection process.

In order to prepare the drilling site, manual clearing is performed. In one example, tall trees are felled near a well centre and trees less than 2 meters tall are maintained. More tall trees are maintained as the distance from the well centre increases. Some larger vegetation is uprooted and piled at a side of the drilling site and some vegetation is cut to level the height thereof. Smaller vegetation is maintained at areas other than the well centre. The drilling site may be selected to have an irregular shape in order to facilitate site reclamation.

Figure 10:
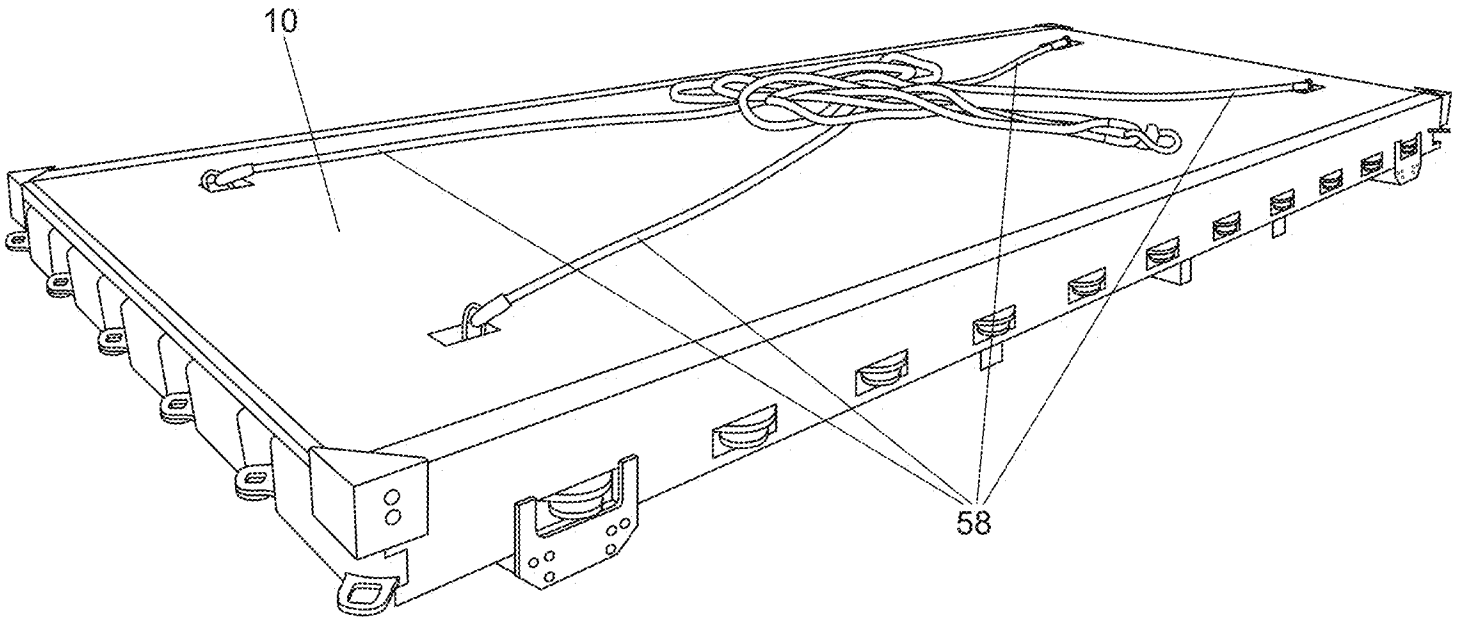
FIG. 10 is a top perspective view of another platform component showing connecting cables coupled to lifting members of the platform component.
Figure 11:
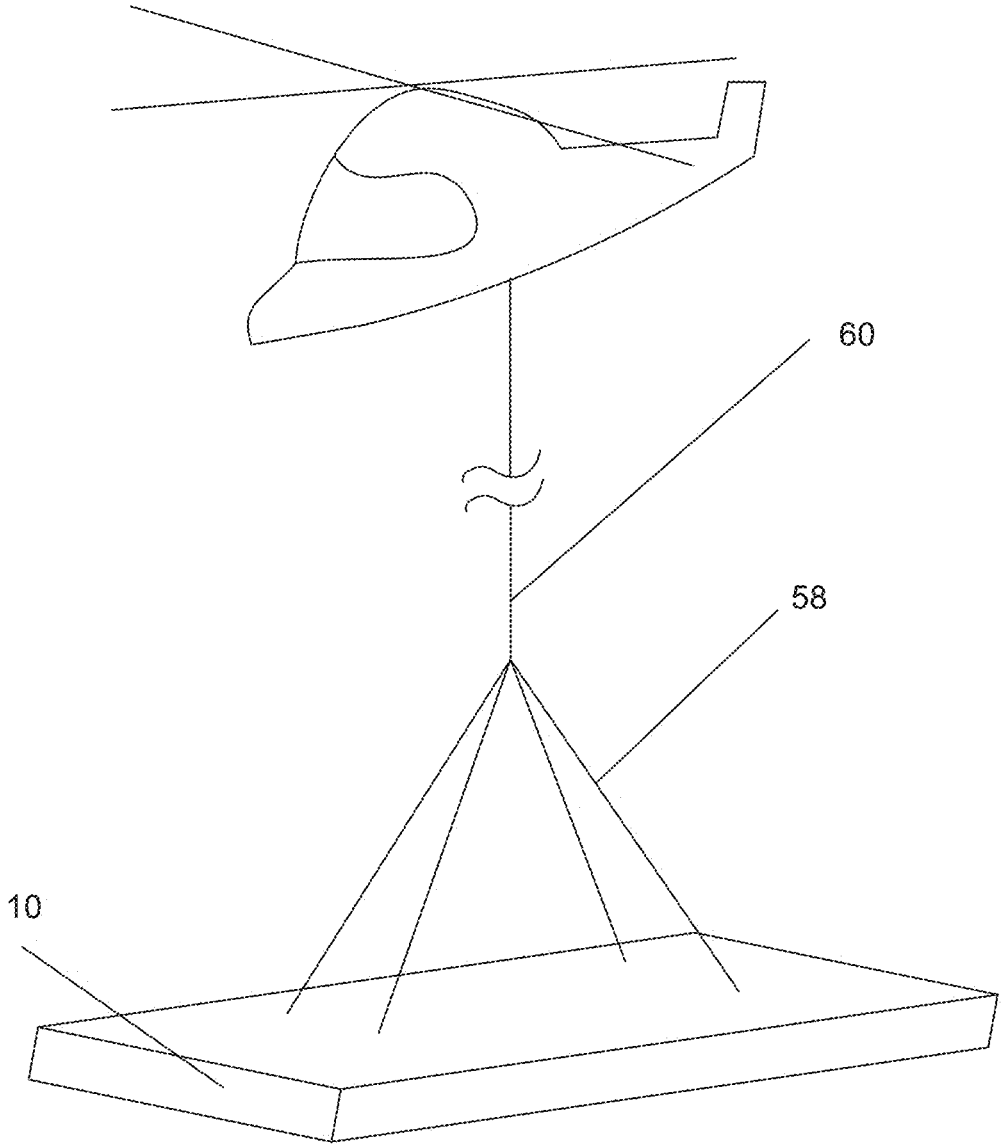
FIG. 11 is a schematic view of a platform component suspended below an aircraft.

In order to transport the platform components 10 from a first location to the drilling site, connecting cables that extend downward from the aircraft are coupled to the lifting members 48 of the platform component 10 and the platform component 10 is lifted by the aircraft. Referring to FIGS. 10 and 11, in an embodiment, connecting cables 58 are synthetic sling lines of approximately 20 ft that extend from a long line 60 that is coupled to the aircraft. As shown in FIG. 11, because the connecting cables are of generally equal length, the platform component is generally level when suspended from the aircraft. Connecting cables 58 having non-equal lengths may alternatively be used. For example, forward connecting cables that are shorter than rear connecting cables would allow the platform component 10 to be transported in a "nose up" configuration and forward connecting cables that are longer than rear connecting cables would allow the platform component 10 to be transported in a "nose down" configuration.

In operation, after the platform component 10 has been coupled to the aircraft, the platform component 10 is lifted by the aircraft and moved from a first location to the drilling site. At the drilling site, the platform component 10 is lowered to the ground and the connecting cables are released from the lifting members 48 so that the aircraft may fly back to the first location to pick up another platform component 10. The platform component 10 rests directly on top of the vegetation at the drilling site. Subsequently delivered platform components 10 may be coupled to platform components 10 at the drilling site to form one or more platforms, such as platforms 100 and 200, for example, of FIG. 9.

At the drilling site, the weight of the platform component 10 causes the cross-members 20 thereof to sink into the unstable ground while the buoyant body 12 maintains the side supports 16, 18 above ground. The cross-members 20 anchor the platform components 10 in place on the ground and provide a stable support for the drilling rig and other operational equipment.

When drilling operations at the drilling site are completed, the platform components 10 may be successively moved away from the drilling site by the aircraft. Reclamation of the drilling site may begin when the drilling site has been cleared of drilling equipment. Because the vegetation is maintained below the platform components 10 during the drilling operation, there is very little ground disturbance and therefore, there is no need to plant grasses. Depending on the pre-disturbed condition of the drilling site, tree planting may also be minimized or avoided.

In order for the aircraft to lift the platform components 10, suction between the platform components 10 and the wet ground must be overcome. The inclusion of many spaced apart buoyant components 30 in the buoyant body 12 results in many small suction areas, which requires less of a lifting force than one large suction area. The curved corners of the buoyant components 30 also reduce the suction between the buoyant components 30 and the ground.

The platform components 10 of the platform 100, 200 may include one or more generally identical platform components 10, may include one or more platform components 10 having a different size or a different construction, or any combination thereof. For example, as shown in FIG. 9, platform component 10*a* includes an opening 56 that extends therethrough. The opening 56 allows access to the ground surface in order to drill a well.

In an embodiment, the grating 44 is omitted and the buoyant body 12 is provided with a non-slip surface.

Because the platform component 10 is transportable by aircraft, testing was performed in order to ensure that, when suspended below the aircraft during transportation, the platform component 10 did not impact the stability of the aircraft. When an aircraft is subject to forces that cause instability, the ability of the aircraft to operate properly is impacted and damage to the aircraft may result. If the instability is significant, an aircraft operator may opt to release the load being transported rather than risk a crash.

Figure 12:
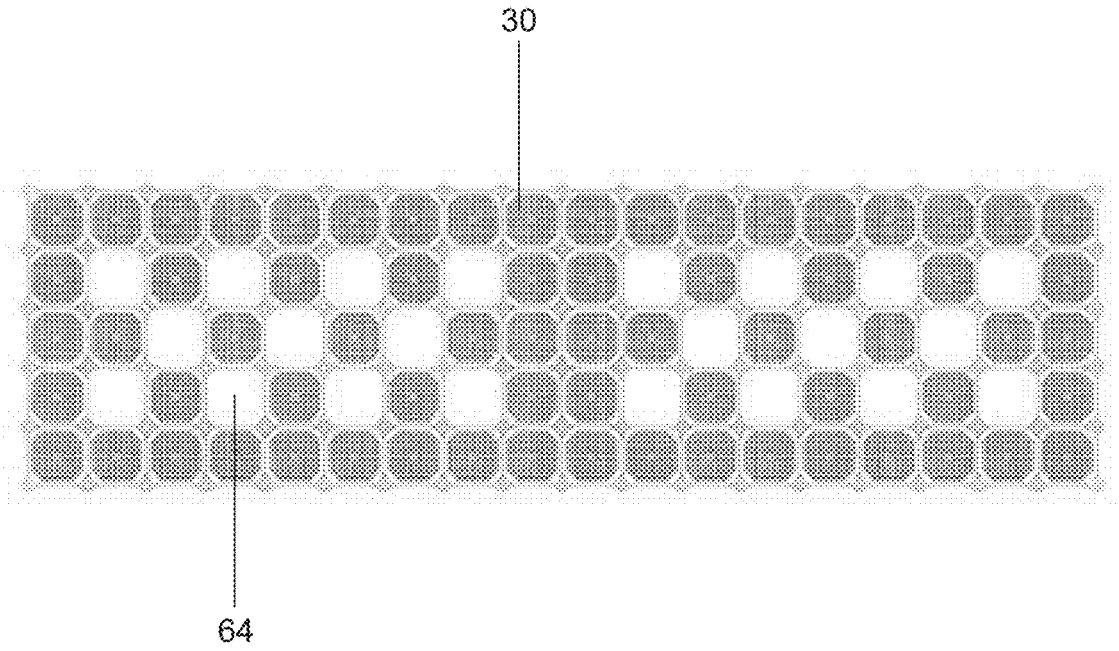
FIG. 12 is schematic view showing a layout of buoyant components for a platform component according to an embodiment.

Referring to FIG. 12, an alternate layout of buoyant components 30 for assembly as part of the platform component 10 is generally shown. According to this embodiment, the distribution of buoyant components 30 throughout the platform component 10 is non-continuous. Buoyant component-sized gaps 64 represent locations at which no buoyant components 30 are present. As shown, portions of the layout are arranged in a "checkerboard" pattern in which some buoyant components 30 are coupled to other buoyant components 30 by the corners thereof and no buoyant components 30 are adjacent to the sides thereof, however, other layouts may be implemented. The buoyant component layout of FIG. 12 decreases the overall weight of the platform component 10 and facilitates increased air flow during transportation when compared to a platform component 10 in which the buoyant components 30 are continuous. The non-continuous buoyant component layout may increase the stability of the platform component 10 when the platform component 10 is transported at speeds greater than approximately 30 knots, for example.

Figure 13:
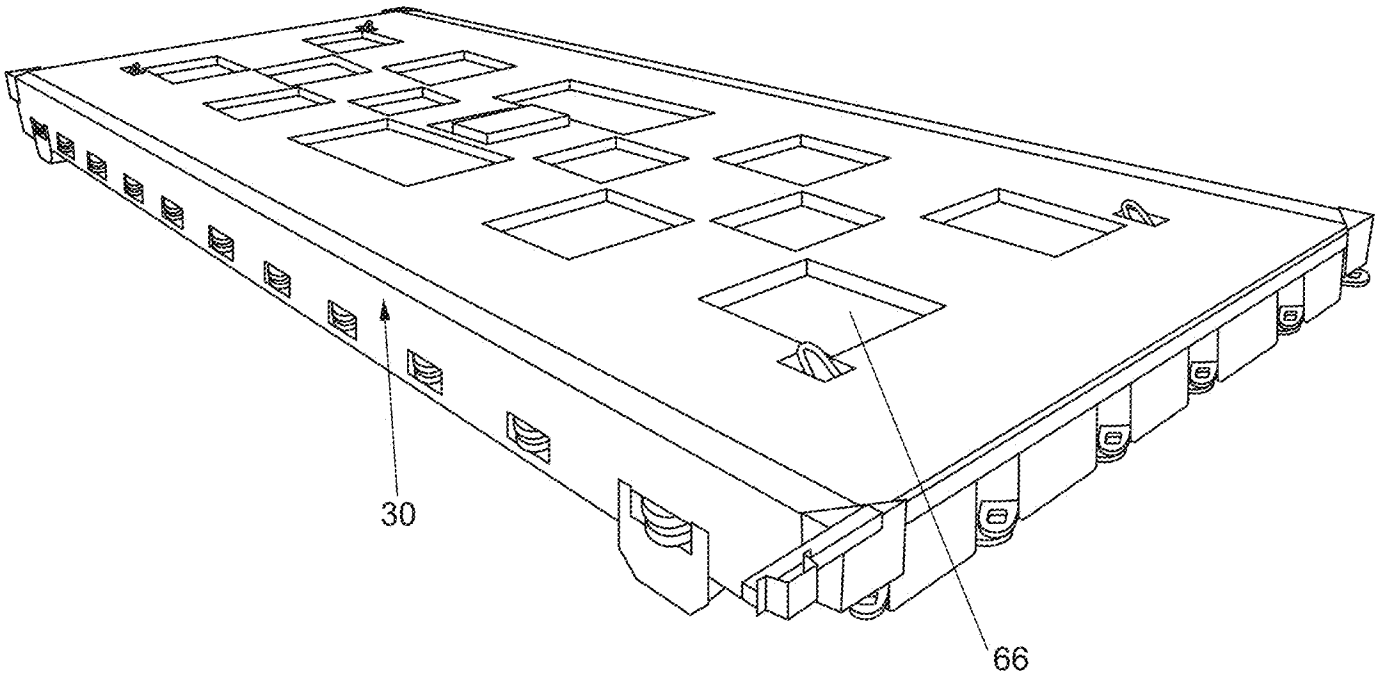
FIG. 13 is a top perspective view of a platform component according to another embodiment.

According to another embodiment, which is shown in FIG. 13, the grating 44 includes cutouts 66 that are generally aligned with the gaps 64 shown in FIG. 12. In this embodiment, the overall weight of the platform component 10 is further reduced and airflow through the platform component 10 may be further increased with respect to the embodiment of FIG. 12. In addition, the platform component 10 according to the embodiment of FIG. 13 may increase the stability of the platform component 10 when the platform component 10 is transported at speeds greater than approximately 40 knots, for example.

A further advantage of the platform component embodiments of FIGS. 12 and 13 is that suction between the buoyant body 12 and the ground when the platform component 10 is lifted by the aircraft is further reduced because a smaller number of buoyant components 30 are provided.

As will be understood by a person skilled in the art, the platform component 10 described herein is not limited to being transportable by an aircraft. The platform component 10 may instead be transportable by truck or other vehicle, for example, to a drilling site having access roads. In a non-aircraft transportable embodiment, the lifting members 48 may be omitted and the grating 44 may be continuous over the surface of the buoyant body 12.

The platform component 10 described herein is for use on unstable ground, however, the platform component 10 may also be used on stable ground. In this embodiment, additional cross-members are provided between the cross-members 20 in order to reduce bending loads resulting from the side supports 16, 18 and the buoyant body 12 being spaced from the ground by the cross-members 20. The additional cross-members may be selectively inserted between the ground and the lower surface of the buoyant body 12 so that no modification of the platform component 10 is performed. In still another embodiment, spacers may be inserted between the side supports 16, 18 and the ground to support the side supports 16, 18 between the cross-members 20. The spacers may be made of foam, carbon fiber or polyethylene, for example.

The platform components 10 are particularly suitable for providing a ground interface on muskeg. Muskeg is in constant motion and is not suitable for walking across. Muskeg is classified by age because the plant matter that makes up muskeg decomposes over time such that younger muskeg is more robust.

The platform component 10 described herein has many advantages, some of which may have already been described. The cross-member 20 functions as an anchor to generally prevent translation of the platform component 10 along its length, which provides a stable surface for supporting drilling operations. In addition, the platform components 10 may be coupled to one another in a side-by-side arrangement in order to provide a platform 100, 200. The platform component 10 is transportable by aircraft, which allows for an extension of a typical winter drilling season and use of the platform components on unstable, unfrozen ground. Because the platform component 10 is made using materials that are generally water-resistant, longevity of the platform component 10 may be extended. Thus, the platform component 10 may be used at different drilling sites for many different drilling operations.

Figure 14A:
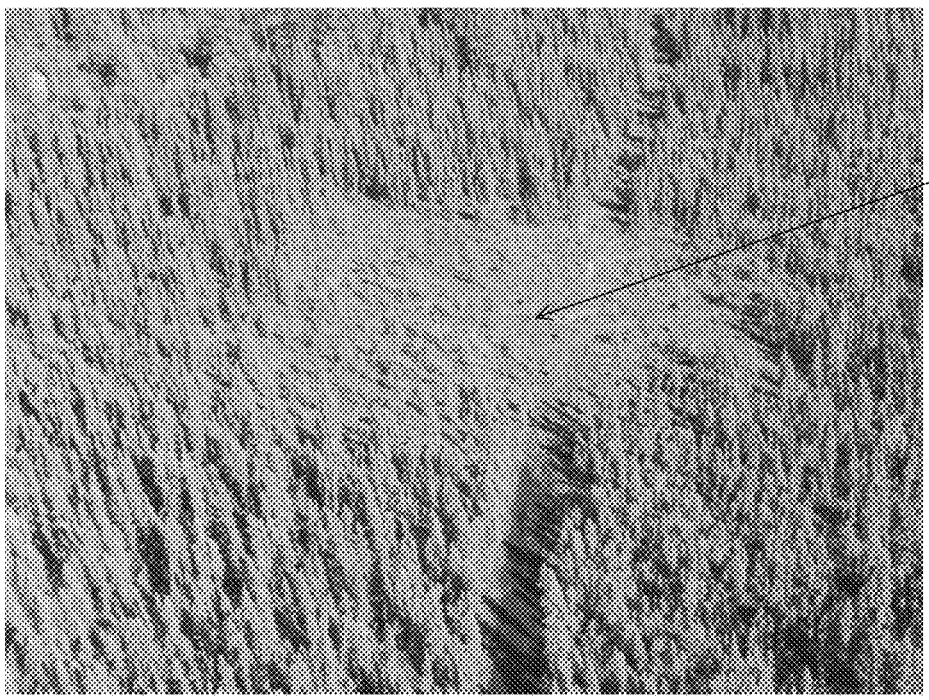
FIG. 14A is an aerial view showing a drilling site after drilling has completed and the drilling rig and platform components have been removed from the site.
Figure 14B:
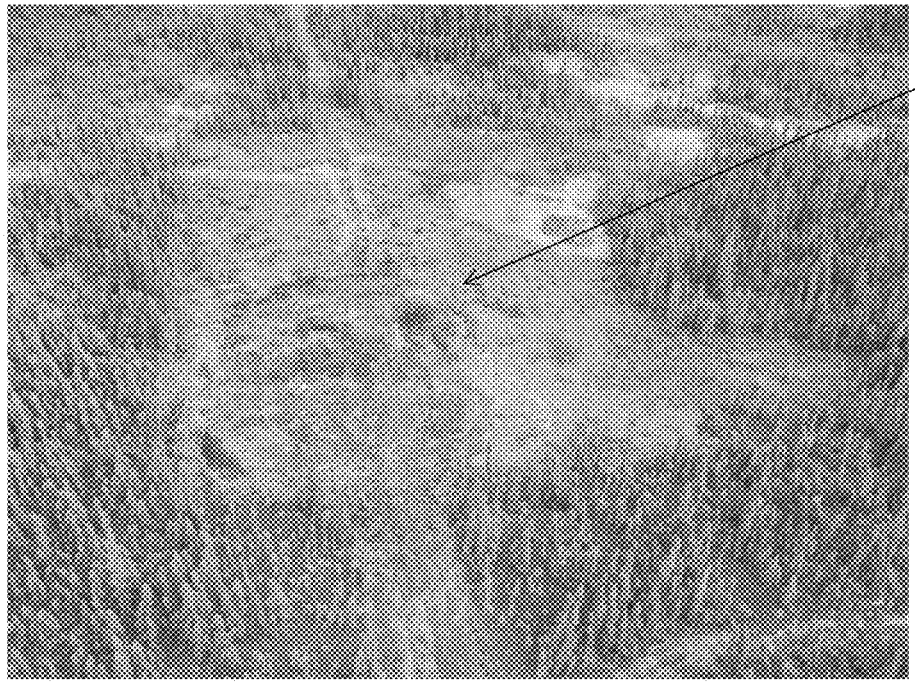
FIG. 14B is an aerial view showing a drilling site in the summer following a winter drilling operation.

Further, the platform component 10 reduces the impact on the environment because the platform component 10 may be placed directly on top of vegetation at the drilling site rather than clearing (removing) the vegetation. In the warmer months, the root system of the trees and vegetation on the land is softer than in winter, therefore, less land is cleared and the vegetation is substantially spared, allowing the vegetation to continue growing after the drilling rig has been disassembled and the platform components 10 have been removed. As shown in FIG. 14A, a disturbed area 68 left following a drilling operation using the platform components 10 described herein is significantly smaller and shows less impact on the vegetation of the site than a disturbed area 70 from a winter drilling operation in which vegetation was cleared and access roads were built.

Reclamation criteria for returning a drilling site to a pre-disturbed condition are set by regulatory bodies and must be met before a reclamation certificate is issued. Criteria relate to: clean up of waste, debris and spills, soil depths, soil placement and soil quality, compatibility of land contour, re-establishment of forest trajectory and erosion and stability of the landscape, for example. Until a reclamation certificate is issued, an abandoned drilling site must be monitored and new vegetation planted, if required, until the abandoned site meets the reclamation criteria. Because the vegetation at the drilling site is still present when the platform component 10 is removed, site reclamation is achieved more rapidly than if the vegetation were cleared prior to placement of the platform component 10. Use of the platform components 10 described herein may reduce reclamation time of a drilling site by three to five years when compared to reclamation of a conventional drilling site. Shortening the reclamation period results in reduced reclamation costs, which reduce the overall cost of the drilling operation.

The above-described embodiments are intended to be examples only. Alterations, modifications and variations can be effected to the particular embodiments by those of skill in the art without departing from the scope of the present application, which is defined solely by the claims appended hereto.

What is claimed is:

1. An aircraft-transportable platform component for supporting a drilling rig, the platform component comprising:

a frame comprising a first portion and a second portion comprising side supports, the first portion protruding from an underside surface of the second portion to support the second portion of the frame thereon and for anchoring the platform component in unstable ground;

a buoyant body supported by the frame to provide buoyancy to the platform component, the buoyant body including buoyant components that include lugs projecting therefrom, wherein the lugs of adjacent buoyant components overlap and are coupled together by connecting pins;

lifting members coupled to the frame for engagement by connecting cables of an aircraft; and a coupling member extending from a first side support of the side supports, the coupling member including a coupling flange for cooperating with an adjacent coupling member of an adjacent aircraft-transportable platform component by receipt of the coupling flange in the adjacent coupling member of the adjacent aircraft-transportable platform component.

2. The aircraft-transportable platform component of claim 1, wherein the buoyant body maintains a top surface of the aircraft-transportable platform component above the unstable ground.

3. The aircraft-transportable platform component of claim 1, comprising grating layered on top of the buoyant body, the grating comprising a non-slip surface.

4. The aircraft-transportable platform component of claim 1, wherein the buoyant body is non-continuous.

5. The aircraft-transportable platform component of claim 1, wherein the buoyant components are generally cuboid.

6. The aircraft-transportable platform component of claim 1, wherein the buoyant body is non-continuous so that buoyant component-sized gaps are provided between some buoyant components.

7. The aircraft-transportable platform component of claim 6, comprising grating layered on top of the buoyant components, the grating comprising cutouts aligned with the buoyant component-sized gaps.

8. The aircraft-transportable platform component of claim 5, wherein the buoyant components are approximately 20"× 20" and approximately 10" thick.

9. The aircraft-transportable platform component of claim 1, wherein the buoyant body is coupled to the second portion of the frame by bolts extending upward from the first portion of the frame.

10. The aircraft-transportable platform component of claim 1, wherein the second portion of the frame comprises:

the first side support and a second side support spaced from one another; and the first side support and the second side support are C-channels, the buoyant body and a cover being sandwiched between upper and lower flanges of the C-channels.

11. The aircraft-transportable platform component of claim 10, wherein a clearance is provided between the upper and lower flanges to facilitate movement of the buoyant body relative to the first and second side supports.

12. The aircraft-transportable platform component of claim 5, comprising bolts extending from the first portion of the frame through gaps located between adjacent buoyant components, wherein the lifting members are coupled to the bolts to extend beyond an upper surface of the buoyant components.

13. The aircraft-transportable platform component of claim 1, wherein the second portion of the frame comprises one of: steel, composite, aluminum and carbon fiber and the first portion of the frame comprises one of: steel, composite, aluminum and carbon fiber.

14. The aircraft-transportable platform component of claim 1, wherein the buoyant body comprises high-density polyethylene.

15. The aircraft-transportable platform component of claim 1, wherein the coupling member comprises a bracket coupled to the first side support and the coupling flange extends from the bracket for engaging a mating bracket and flange of the adjacent aircraft-transportable platform component.

16. The aircraft-transportable platform component of claim 1, wherein the buoyant body is water-resistant.

17. A platform for supporting a drilling rig, the platform comprising:

a plurality of aircraft-transportable platform components, each aircraft-transportable platform component comprising:

a frame comprising a first portion and a second portion comprising side supports, the first portion protruding from an underside surface of the second portion to support the second portion of the frame thereon and for anchoring the platform component in unstable ground;

a buoyant body supported by the frame to provide buoyancy to the platform component, the buoyant body including buoyant components that include lugs projecting therefrom, wherein the lugs of adjacent buoyant components overlap and are coupled together by connecting pins;

lifting members coupled to the frame for engagement by connecting cables of an aircraft; and a coupling member extending from a first side support of the side supports, the coupling member including a coupling flange for cooperating with an adjacent coupling member of an adjacent one of the plurality of aircraft-transportable platform components by receipt of the coupling flange in the adjacent coupling member;

wherein the plurality of aircraft-transportable platform components are coupled to one another to provide the platform.

18. The platform of claim 17, wherein one of the multiple aircraft-transportable platform components comprises an opening for enabling ground access by a drill string of the drilling rig.

19. The platform according to claim 17, wherein the coupling member comprises a bracket that extends from the first side support and the coupling flange extends from the bracket.

* * * * *